US006290553B1

(12) United States Patent
Sato et al.

(10) Patent No.: US 6,290,553 B1
(45) Date of Patent: Sep. 18, 2001

(54) FEMALE TERMINAL

(75) Inventors: Naotoshi Sato; Masaya Yamamoto; Satoshi Yamada, all of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/564,678

(22) Filed: May 4, 2000

(30) Foreign Application Priority Data

May 11, 1999 (JP) ..... 11-130168

(51) Int. Cl.[7] ..... H01R 13/187
(52) U.S. Cl. ..... 439/843; 439/852; 439/845
(58) Field of Search ..... 439/842, 843, 439/845, 846, 847, 850, 851, 852, 839

(56) References Cited

U.S. PATENT DOCUMENTS 5,690,517 * 11/1997 Betsui ..... 439/843
6,062,918 * 5/2000 Myer et al. ..... 439/843

FOREIGN PATENT DOCUMENTS 10-189102 7/1998 (JP) .
98/29924 7/1998 (WO) .

* cited by examiner

*Primary Examiner*—Paula Bradley
*Assistant Examiner*—Tho D. Ta
(74) *Attorney, Agent, or Firm*—Sughrue, Mion, Zinn, Macpeak & Seas, PLLC

(57) ABSTRACT

In a female terminal (10), projections (17) of a contact piece (12), received within a body (11), are engaged respectively in windows (16) formed respectively in opposed walls (15) of the body (11). A support portion (31), formed on the body (11), is resiliently held against a concave surface (18A) of the contact piece (12). The support portion (31) is held against the contact piece (12) through an engagement portion (40) which makes a concave-convex engagement in a direction of a thickness of the contact piece (12).

8 Claims, 2 Drawing Sheets

FEMALE TERMINAL

BACKGROUND OF THE INVENTION

1. Field of the Invention

The present invention relates to a female terminal used in the wiring in an automobile or the like. The present application is based on Japanese Patent Application No. Hei. 11-130168, which is incorporated herein by reference.

2. Description of the Related Art

As shown in FIG. 2, a female terminal 20, used in the wiring in an automobile or the like, is adapted to be connected to a strip-like male terminal, and includes a body 21 of a square tubular shape for receiving the male terminal therein, a contact piece 22 received within the body 21, and clamping portions 23 and 24 connected to the body 21.

The body 21 has a pair of opposed walls 25 and 25 through which windows 26 and 26 are formed, respectively (see FIG. 2C).

The contact piece 22 has a generally curved strip-shape, and a pair of projections 27 and 27 are formed on and extend respectively from opposite side (lateral) edges of the contact piece 22 away from each other. The two projections 27 and 27 of the contact piece 22 are engaged respectively in the windows 26 and 26, with a convexly-arcuate surface 28 facing an inner surface 29 of the body 21, so that opposite end portions of the contact piece 22, spaced from each other in a direction of curvature thereof, are held in contact with an inner surface 30 of the body 21.

When the male terminal is inserted between the inner surface 29 of the body 21 and the arcuate surface 28 of the contact piece 22, the female terminal 20 holds the male terminal in a direction of a thickness of the male terminal, and therefore is connected to the male terminal.

In the female terminal 20, the contact piece 22 needs to be mounted within the body 21, and therefore an inner dimension of the windows 26 is larger than an outer dimension of the projections 27.

Namely, in the female terminal 20, the contact piece 22 can shake relative to the body 21 in the direction of insertion of the male terminal, and therefore there has been encountered a problem that the reliability of connection to the male terminal is low.

SUMMARY OF THE INVENTION

With the above problem in view, it is an object of the present invention to provide a female terminal which can hold a male terminal in a direction of a thickness thereof, and can be connected thereto in a stable manner.

To achieve the above object, according to the first aspect of the present invention, there is provided a female terminal which comprises a body including a hollow electrical contact portion into which a male terminal is insertable, the electrical contact portion including opposite side walls which have windows respectively formed therein, a resilient contact piece disposed in the electrical contact portion, the contact piece including a substantially curved portion and a pair of projections which are respectively extended from opposite side edges of the substantially curved portion, and are respectively engaged in the windows of the electrical contact portion, and a resilient support portion disposed in the electrical contact portion, the support portion abutting against the substantially curved portion of the contact piece to urge the contact piece.

The support portion may be formed, for example, by stamping a relevant portion of the wall of the body facing the concave surface of the contact piece. Accordingly, for example, the support portion may be formed on a bottom wall of the electrical contact portion in a cantilevered manner. In this case, the contact piece is effectively urged upwardly by the support portion. Further, it is preferable that a projecting portion is formed on a upper wall of the electrical contact portion to oppose to one of the concave portion and the convex portion. In this case, the male terminal, inserted in the electrical contact portion, is effectively held between the projecting portion and the contact piece.

Preferably, the female terminal may further comprise a concave portion, and a convex portion engaged in the concave portion, as a engagement mechanism. In this case, the contact piece includes one of the concave portion and the convex portion, and the support portion includes the other one of the concave portion and the convex portion. However, the shape, size, number and so on of the concave and convex portions are suitably selected.

In the female terminal of the above construction, the support portion is resiliently held against the concave surface of the contact piece. Therefore, even if respective inner dimensions of the windows are larger than respective outer dimensions of the projections, the projections are kept pressed respectively against predetermined portions of inner (peripheral) edges of the windows.

In the female terminal, since the support portion can be held against the contact piece through the engagement mechanism, the movement of the contact piece relative to the body is prevented, and therefore the reliability of connection of the female terminal to the male terminal can be enhanced as compared with the above-related construction.

Further, according to the second aspect of the present invention, it is preferable that the engagement mechanism includes a convex semispherical surface, formed on one of the contact piece and the support portion, and a concave semispherical surface formed in the other one of the contact piece and the support portion. Accordingly, the contact piece and the support portion are held in contact with each other through the convex semi-spherical surface and the concave semi-spherical surface. Therefore, even if an error develops in the radius of curvature of the convex semi-spherical surface and the concave semispherical surface, the concave-convex engagement can be maintained.

In the meantime, in the above-related female terminal, the respective inner dimensions of the windows are different from the respective outer dimensions of the projections as described above, and therefore when the male terminal is inserted, the contact piece can be moved relative to the body by an amount corresponding to the difference of the dimensions. In other words, an inserting resistance, obtained when inserting the male terminal into the above-related female terminal, is not constant, and therefore there has been a possibility that a connection error occurs.

On the other hand, according to the third aspect of the present invention, the radius of curvature of the concave semi-spherical surface is smaller than the radius of curvature of the convex semi-spherical surface, and therefore the concave semi-spherical surface is held in circular line contact with the convex semi-spherical surface. Therefore, the contact piece can not be moved relative to the body, and therefore when inserting the male terminal, a stable inserting resistance can be obtained.

DETAILED DESCRIPTION OF THE PREFERRED EMBODIMENT

Figure 1A:
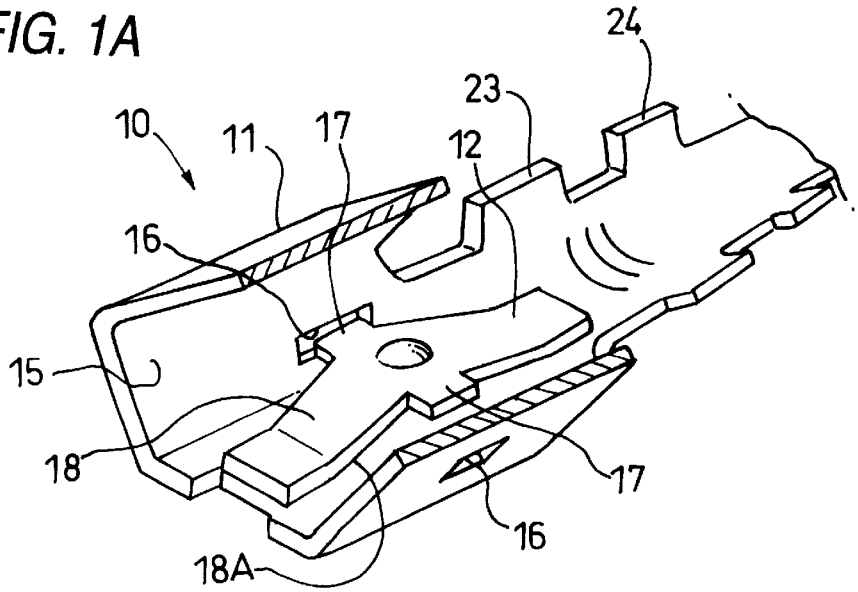
FIGS. 1A, 1B and 1C are a partly-broken, perspective view, a cross-sectional view and a fragmentary, cross-sectional view of a preferred embodiment of the present invention, respectively.

A preferred embodiment of the present invention will now be described in detail with reference to FIGS. 1A, 1B and 1C. Those parts of this embodiment, similar to those of FIGS. 2A, 2B and 2C, will be designated by like reference numerals, respectively, and explanation thereof will be omitted or simplified.

Figure 1B:
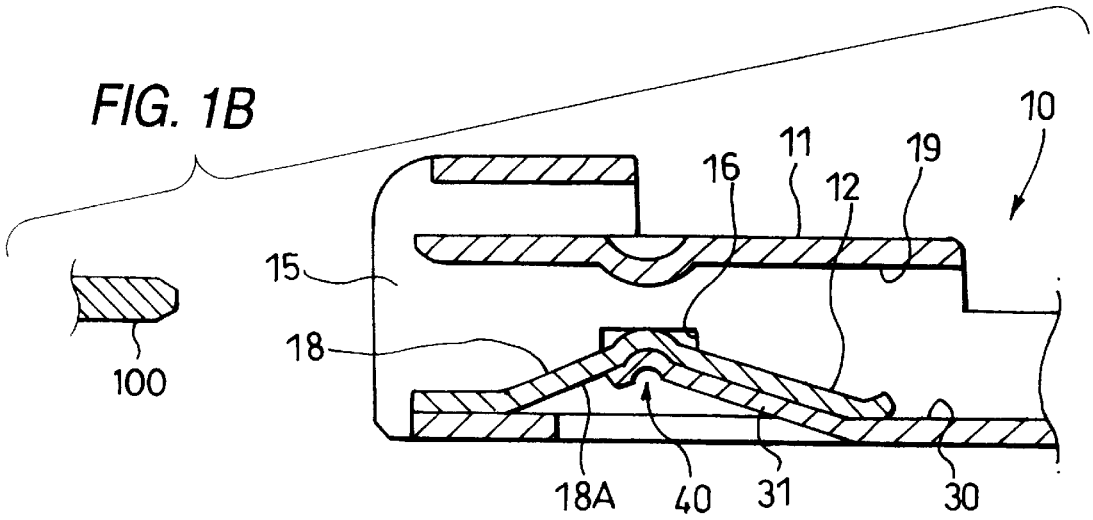
Figure 1C:
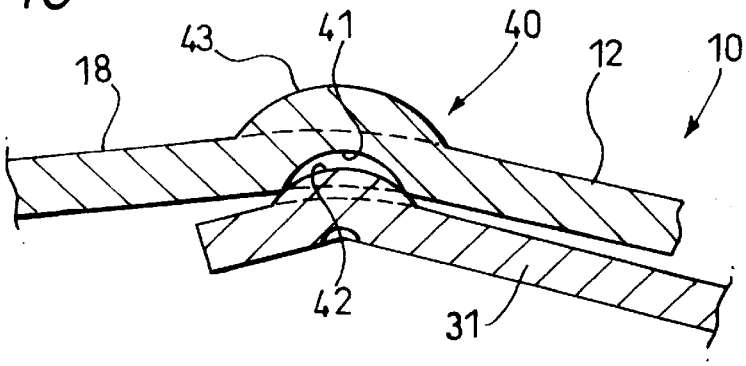
Figure 2A:
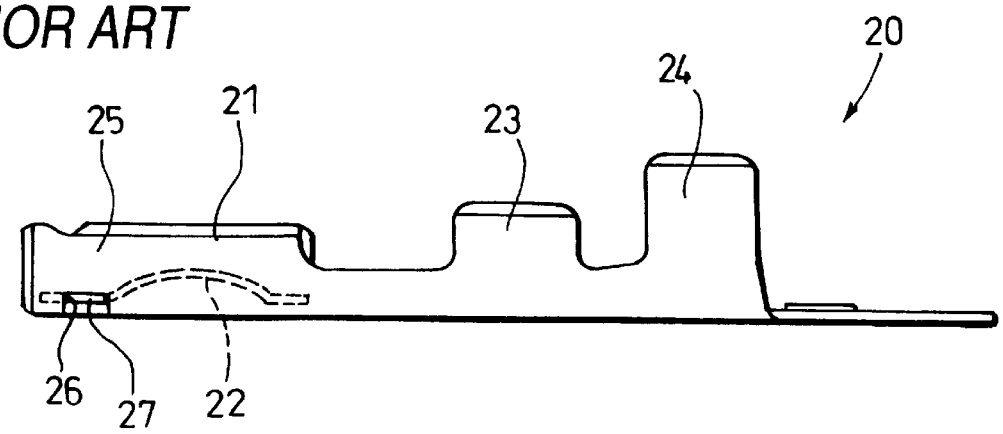
FIG. 2A PRIOR ART
FIGS. 2A, 2B and 2C are a side-elevational view, a cross-sectional view and a partly-broken, perspective view of a related female terminal, respectively.
Figure 2B:
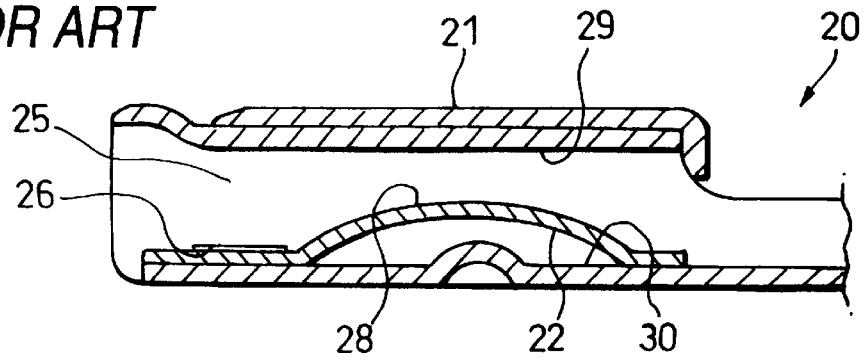
FIG. 2B PRIOR ART
Figure 2C:
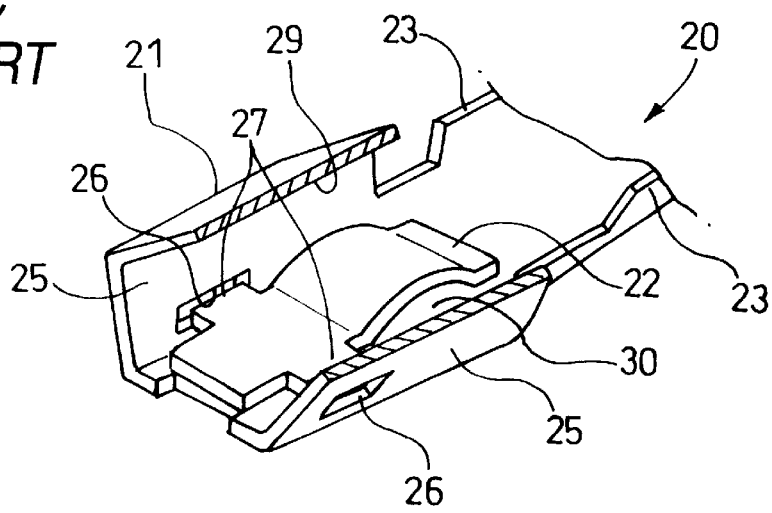
FIG. 2C PRIOR ART

As shown in FIGS. 1A to 1C, a female terminal 10 of this embodiment includes a body 11 of a square tubular shape for receiving a strip-like male terminal 100 therein, and a contact piece 12 of a curved strip-like shape received within the body 10.

The contact piece 12 is in the form of a strip curved into a generally obtuse-angle L-shaped cross-section. A pair of projections 17 and 17 are formed respectively on generally central portions of opposite side (lateral) edges of the contact piece 12. The projections 17 and 17 of the contact piece 12 are engaged respectively in windows 16 and 16, formed respectively through opposed walls 15 and 15 of the body 11, so that opposite end portions of the contact piece 12, spaced from each other in the longitudinal direction, are held in contact with an inner surface 30 of the body 11.

In this female terminal 10, a support portion 31, formed on the inner surface 30 of the body 11, is resiliently held against a concave surface 18A of the contact piece 12.

The support portion 31 is formed by stamping a wall of the body 11, and has a generally strip-like shape, and is resiliently held against the concave surface 18A of the contact piece 12.

The contact piece 12 is positioned relative to the support portion 31 by an engagement mechanism 40 which makes a concave-convex engagement in the direction of the thickness of the contact piece 12.

The engagement mechanism 40 includes a concave semi-spherical surface 41, formed in the concave surface 18A of the contact piece 12, and a convex semi-spherical surface 42 formed on the support portion 31.

As shown in FIG. 1C, in this engagement mechanism 40, the radius of curvature of the concave semi-spherical surface 41 is smaller than the radius of curvature of the convex semispherical surface 42, and a peripheral edge of an opening of the concave semi-spherical surface 41 is disposed in circular line contact with the convex semi-spherical surface 42.

In this embodiment, a convex semi-spherical surface 43 is formed on a convex surface 18 of the contact piece 12. The convex semi-spherical surface 43 is provided at that portion of the convex surface 18 corresponding to the concave semi-spherical surface 41, and this convex semispherical surface 43 can be held in point contact with the male terminal 100.

In the female terminal 10, the support portion 31, formed on the inner surface 30 of the body 11, is resiliently held against the concave surface 18A of the contact piece 12. Therefore, although an inner dimension of the windows 16 and 16 is larger than an outer dimension of the projections 17 and 17, the contact piece 12 is urged toward an inner surface 19 of the body 11, with the projections 17 and 17 pressed respectively against predetermined portions of inner (peripheral) edges of the windows 16 and 16.

In this female terminal 10, since the support portion 31 urges the contact piece 12 through the engagement mechanism 40, the contact piece 12 will not move relative to the body 11 in a direction of insertion of the male terminal 100, and therefore the reliability of connection of the female terminal to the male terminal 100 can be enhanced as compared with the related construction.

In this female terminal, the contact piece 12 and the support portion 31 are held in contact with each other through the concave semi-spherical surface 41 and the convex semi-spherical surface 42, and therefore even if an error develops in the radius of curvature of the concave semi-spherical surface 41 and the convex semi-spherical surface 42, the concave-convex engagement can be maintained.

Particularly in this engagement mechanism 40, the radius of curvature of the concave semispherical surface 41 is smaller than the radius of curvature of the convex semi-spherical surface 42, and therefore the concave semi-spherical surface 41 is held in circular line contact with the convex semi-spherical surface 42. Therefore, in this female terminal 10, the contact piece 12 can not be moved relative to the body 11, and therefore when inserting the male terminal 100, a stable inserting resistance can be obtained.

The convex semi-spherical surface 43 is formed on the convex surface 18 of the contact piece 12, and therefore the contact piece 12 can be held in point contact with the male terminal 100 at the convex semi-spherical surface 43, and therefore a resistance, produced when connecting the female terminal to the male terminal 100, can be reduced.

The present invention is not limited to the above embodiment, and suitable modifications and improvements can be made.

For example, the engagement mechanism is not limited to the combination of the concave semispherical surface and the convex semi-spherical surface, but a conical convex portion, a pillar-like convex portion or other suitable convex portion can be used in combination with a suitable concave portion, and these can be selectively and exclusively for the contact piece and the support portion.

The material, shape, size, form, number and arrangement of the body, the contact piece, the inner surface, the projections, the walls, the windows, the female terminal, the support portion, the concave surface, the engagement mechanism, the convex semi-spherical surface, the concave semispherical surface and so on are arbitrary, and are not limited in so far as the present invention can be achieved.

As described above, in the present invention, the support portion urges the contact piece through the engagement mechanism, thereby limiting the movement of the contact piece relative to the body, and therefore the reliability of connection to the male terminal can be enhanced as compared with the related construction.

In the present invention, the contact piece and the support portion are held in contact with each other through the convex semi-spherical surface and the concave semi-spherical surface, nd therefore even if an error develops in the radius of curvature of the convex semi-spherical surface and the concave semi-spherical surface, the concave-convex engagement can be maintained.

In the present invention, the radius of curvature of the concave semi-spherical surface is smaller than the radius of curvature of the convex semi-spherical surface, and therefore the concave semi-spherical surface is held in circular line contact with the convex semi-spherical surface. Therefore, the contact piece can not be moved relative to the body, and therefore when inserting the male terminal, a stable inserting resistance can be obtained.

What is claimed is:

1. A female terminal, comprising:

a body including a hollow electrical contact portion into which a male terminal is insertable, the electrical contact portion including opposite side walls which have windows respectively formed therein;

a resilient contact piece disposed in the electrical contact portion, the contact piece including a substantially curved portion and a pair of projections which are respectively extended from opposite side edges of the substantially curved portion, and are respectively engaged in the windows of the electrical contact portion; and a resilient support portion disposed in the electrical contact portion, the support portion abutting against the substantially curved portion of the contact piece to urge the contact piece.

2. The female terminal of claim 1, wherein the support portion is formed on a bottom wall of the electrical contact portion in a cantilevered manner.

3. The female terminal of claim 1, further comprising:

a convex surface formed on one of the contact piece and the support portion, and a concave surface formed in the other one of the contact piece and the support portion.

4. The female terminal of claim 3, wherein the convex surface is a convex semi-spherical surface, and the concave surface is a concave semi-spherical surface, and wherein a radius of curvature of the concave semi-spherical surface is smaller than a radius of curvature of the convex semi-spherical surface.

5. The female terminal of claim 3, wherein an outer configuration of the concave surface is smaller than an outer configuration of the convex surface.

6. The female terminal of claim 3, wherein the convex surface is formed on the support portion, and the concave surface is formed on the contact piece, and wherein the convex surface engages with the concave surface to form an engagement mechanism.

7. The female terminal of claim 3, wherein the support portion is formed on a bottom wall of the electrical contact portion, the contact piece is upwardly urged by the support portion.

8. The female terminal of claim 7, further comprising a projecting portion formed on an upper wall of the electrical contact portion to face said contact piece.

* * * * *